United States Patent [19]

Ushikoshi

[11] Patent Number: 4,762,461

[45] Date of Patent: Aug. 9, 1988

[54] LEAKLESS PUMP

[75] Inventor: Ryusuke Ushikoshi, Handa, Japan

[73] Assignee: NGK Insulators Ltd., Aichi, Japan

[21] Appl. No.: 941,105

[22] Filed: Dec. 12, 1986

[30] Foreign Application Priority Data

Dec. 20, 1985 [JP] Japan ..... 60-195291
Aug. 4, 1986 [JP] Japan ..... 61-182892

[51] Int. Cl.[4] ..... F04D 29/00

[52] U.S. Cl. ..... 415/14; 415/26; 415/118

[58] Field of Search ..... 415/118, 14, 26, 53 R, 415/48, 49, 106, 140; 417/420

[56] References Cited

U.S. PATENT DOCUMENTS

| | | | |
|---|---|---|---|
| 2,839,071 | 6/1958 | Rosch | 415/418 |
| 2,888,023 | 5/1959 | Eggenberger | 415/14 |
| 3,002,374 | 10/1961 | Jacobs | 415/14 |
| 3,220,244 | 11/1965 | Donelly . | |
| 3,542,494 | 11/1970 | Sato . | |
| 3,797,451 | 3/1974 | Tiraspolsky | 415/118 |
| 3,861,818 | 1/1975 | Eggenberger | 415/118 |
| 4,302,963 | 12/1981 | Collins | 415/14 |
| 4,613,289 | 9/1986 | Kotera | 417/420 |

FOREIGN PATENT DOCUMENTS

| | | |
|---|---|---|
| 2505570 | 11/1975 | Fed. Rep. of Germany . |
| 3037633 | 5/1982 | Fed. Rep. of Germany . |
| 3413930 | 10/1985 | Fed. Rep. of Germany . |
| 1346066 | 2/1974 | United Kingdom . |

*Primary Examiner*—Larry I. Schwartz
*Attorney, Agent, or Firm*—Parkhurst & Oliff

[57] ABSTRACT

A leakless pump for sucking and delivering a liquid includes a rotor having an impeller thereon and rotatably journaled by bearings, and a casing surrounding the rotor and the impeller. The pump comprises a bypath for flowing part of the liquid from a high pressure portion in the proximity of an outer circumference of the impeller to a low pressure portion on a side of an inlet of the pump, at least one pressure detecting aperture formed in the casing and having an inner end communicating with the bypath for measuring change in pressure in the bypath due to wear of at least one of the bearings, and pressure detecting means provided at an outer end of the pressure detecting aperture for detecting pressure change in the bypath, thereby detecting the change in pressure to detect wear of the bearings. The leakless pump is preferably further provided with at least one pressure detecting aperture opening in the high pressure portion to detect the pressure therein, thereby more exactly detecting the bearing wear by pressure difference between pressures in the bypath and the high pressure portion.

11 Claims, 11 Drawing Sheets

LEAKLESS PUMP

BACKGROUND OF THE INVENTION

This invention relates to a leakless pump capable of detecting wear of its bearings for previously preventing troubles of its main members due to the wear of the bearings.

There have been leakless pumps constructed particularly for the purpose of transferring harmful chemical and medicinal liquids, expensive chemical liquids, high temperature liquids and the like. In general, these leakless pumps utilize sliding bearings or plane bearings incorporated therein. In this hitherto used leakless pumps, however, worn conditions of such bearings cannot be detected from the outside of the pumps. Accordingly, although bearings have worn off to an extent to be exchanged with new ones, they are often still used until a rotor is brought into contact with a casing to damage it resulting in leakage of a liquid.

In order to overcome such a disadvantage, for example, Japanese Laid-open Patent Application No. 50-54,903 discloses detecting means for detecting positional change of a rotor including an impeller with the aid of a magnet built in the rotor and a coil located near to the rotor. With a pump intermittently operated with repeating temperature rise and drop between the room temperature and 150° C., however, the magnetic force of the magnet changes with the temperature variation in a range of the order of about 10%. The change in the magnetic force greatly affects the magnetic field to make difficult the exact detection of the wear of bearings. In such a system, moreover, the positional change of the rotor is detected with the aid of electric voltage which is susceptible to external disturbance. Therefore, an exact detection of the bearing wear cannot be expected.

SUMMARY OF THE INVENTION

It is a principal object of the invention to provide an improved leakless pump having bearing wear detecting means, which eliminates all the disadvantages of the prior art and is able to detect bearing wear to previously prevent troubles of pump members due to the bearing wear and is also able to prevent a rotor of the pump from being rotated in a pump chamber without a sufficient amount of a liquid.

In order to achieve this object, a leakless pump for sucking and delivering a liquid including a rotor having an impeller thereon and rotatably journaled by bearings, and a casing surrounding said rotor and said impeller according to the invention comprises a bypath for flowing part of the liquid from a high pressure portion in the proximity of an outer circumference of said impeller to a low pressure portion on a side of an inlet of the pump, at least one pressure detecting aperture formed in said casing and having an inner end communicating with said bypath for measuring change in pressure in said bypath due to wear of at least one of said bearings, and pressure detecting means provided at an outer end of said pressure detecting aperture for detecting pressure change in said bypath.

With this arrangement, the pressure in the bypath is always measured to detect the change in pressure due to wear of the bearings, thereby effectively detecting the wear of the bearings. Moreover, such a measurement of the liquid pressure can detect nonexistence of liquid in a pump casing, so that the pump is prevented from being operated when the pump casing does not include a sufficient amount of a liquid, thereby preventing any trouble due to an operation of the pump devoid of the sufficient liquid.

It is a further object of the invention to provide an improved leakless pump which is able to detect bearing wear even flow rate is changed, thereby detecting flow rate of cooling liquid in the pump and damage of members of the pump such as a shaft.

In order to achieve this object, according to the invention, there are provided at least one pressure detecting aperture opening in the bypath and at least one pressure detecting aperture opening in the high pressure portion to detect the bearing wear with the aid of pressure difference between detected pressures.

With such an arrangement, the bearing wear can be exactly detected even if the flow rate is changed because the pressure difference is utilized which is obtained from pressures detected by at least two pressure detectors located at separate positions.

Moreover, the pressure detecting means may be provided at any position in a leakless pump. It is preferable that they are arranged at two locations where the pressure change will occur due to change in position of a rotor or change in clearance of bearings resulting from the bearing wear and where the pressure change will not occur. The pressure detecting means to be located where the pressure change will not occur may be arranged at any locations on a delivery side of the pump.

In order that the invention may be more clearly understood, preferred embodiments will be described, by way of example, with reference to the accompanying drawings.

DESCRIPTION OF THE PREFERRED EMBODIMENTS

Figure 1:
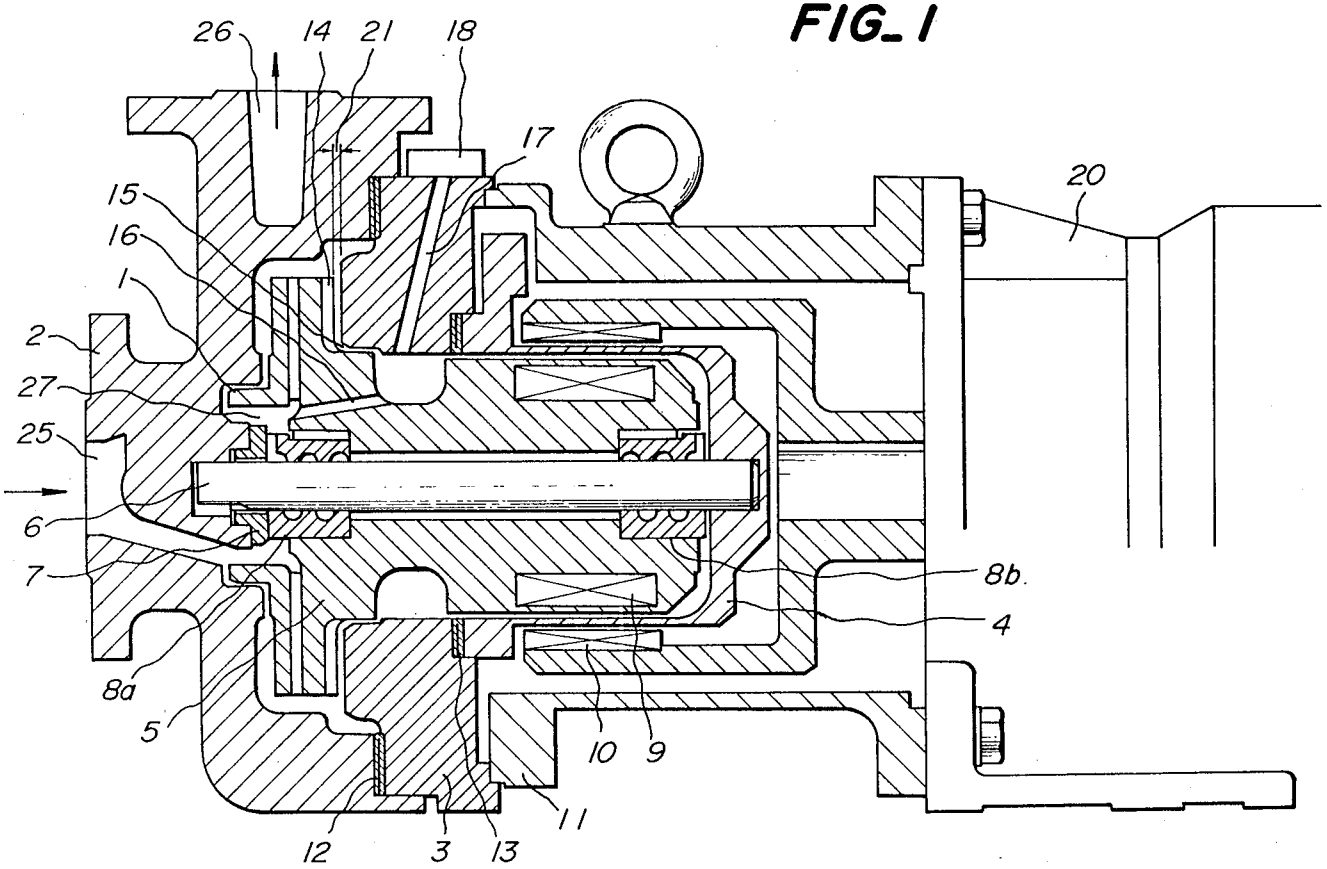
FIG. 1 is a sectional view of a leakless pump of one embodiment of the invention.

FIG. 1 illustrates in section a magnet pump as a leakless pump according to the invention. The leakless pump of this embodiment comprises a rotor 5 having a driven magnet 9 at one end and an impeller 1 at the other end and arranged on a shaft 6 fixed at both ends to a casing 2, and a can or a cup-shaped member 4 through a front bearing 8*a* and a rear bearing 8*b*. The cup-shaped member 4 is fixed through an end cover 3 to the casing 2, between which members are provided gaskets 12 and 13 so that a liquid introduced through an inlet 25 of the casing 2 is fed in a liquid tight manner to an outlet 26 of the casing 2. Part of the liquid flows from a high pressure space at an outer circumference of the impeller 1 of the rotor 5 through rear blades 14, an orifice 15, a space between the end cover 3 and the rotor 5, and balance holes 16 into an entry portion 27 and on the other hand through a space between the cup-shaped member 4 and the rotor 5 and helical grooves formed in slide surfaces of the rear and front bearings 8*b* and 8*a* into the entry portion 27. In other words, a bypath is formed for the part of the liquid. The rotor 5 is rotatably supported by the front and rear bearings 8*a* and 8*b* fitted on the shaft 6 and a thrust bearing for supporting thrust force of the rotor 5.

A driving magnet 10 is provided in an outer circumference of the cup-shaped member 4 in opposition to the driven magnet 9. The driving magnet 10 is connected to a rotating shaft of a motor 20 fixed through a stand 11 to the end cover 3 so that the driving magnet is rotated about the cup-shaped member 4 when the motor 20 is energized. According to this embodiment, a pressure detecting aperture 17 is provided in an upper portion of the end cover 3 so as to permit one end of the pressure detecting aperture 17 to communicate with the space between the orifice 15 and the balance holes 16. The other end of the pressure detecting aperture 17 extends and terminates in an outer periphery of the end cover 3 to detect the pressure in the space with the aid of a pressure sensor 18 provided on the outer periphery of the end cover 3 at the other end of the pressure detecting aperture 17.

In the magnet pump of the embodiment of the leakless pump according to the invention, in order to cause the front bearing 8*a* as a sliding bearing to abut against the thrust bearing 7, there are provided the rear blades 14, the orifice 15 and the balance holes 16 to adjust various pressures acting upon the rotor 5 and at the same time to obtain the minimum proper value of the abutting force between the thrust bearing 7 and the front bearing 8*a*.

Although such an adjusting method of an axial force (thrust force) has been known, the present invention has been accomplished as a result of inventor's further investigation of the adjusting method. This invention resides in the discovery that when the front bearing 8*a* and the thrust bearing 7 abutting against each other have worn off to change the position of the rotor, the positional relation between the rear blades 14 and the casing 2 is changed so as to vary a gap 21 between them to cause a pressure variation in the spaces from the rear blades 14 through the orifice 15 to the balance holes 16. For this purpose, the pressure detecting aperture 17 extending to the space between the orifice 15 and the balance holes 16 is formed in the end cover 3 and the pressure sensor 18 is provided at the outer end of the pressure detecting aperture 17 to detect the pressure change and hence the bearing wear. Moreover, the pressure detecting aperture 17 and the pressure sensor 18 also detect nonexistence of pressure in the casing in the event that the pump is operated in spite of the nonexistence of any liquid in the casing. Accordingly, such an erroneous operation of the pump can be prevented.

Figure 2:
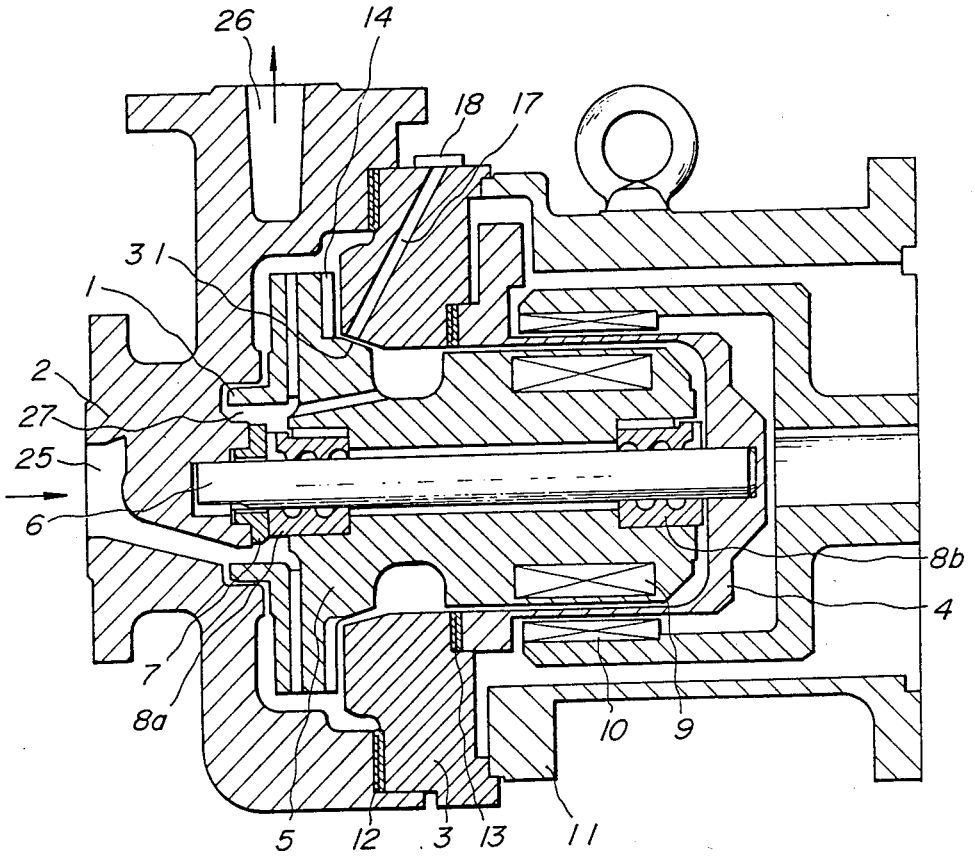
FIG. 2 is a sectional view of a leakless pump of another embodiment of the invention.

FIG. 2 illustrates in section another embodiment of the invention, wherein like components have been designated by the same reference numerals as those in FIG. 1 and will not be described in further detail. The embodiment shown in FIG. 2 is similar to the embodiment shown in FIG. 1 with exception of an orifice 31 oblique to an axis of the pump. In this embodiment shown in FIG. 2, as the pressure change in the space between the orifice 31 and the balance holes 16 is much clearer than in the previous embodiment, so that the detection of pressure is carried out with ease. Therefore, an inner end of the pressure detecting aperture 17 is located so as to face the orifice 31. The oblique angle of the orifice to the axis of the pump may be determined at will.

Figure 3:
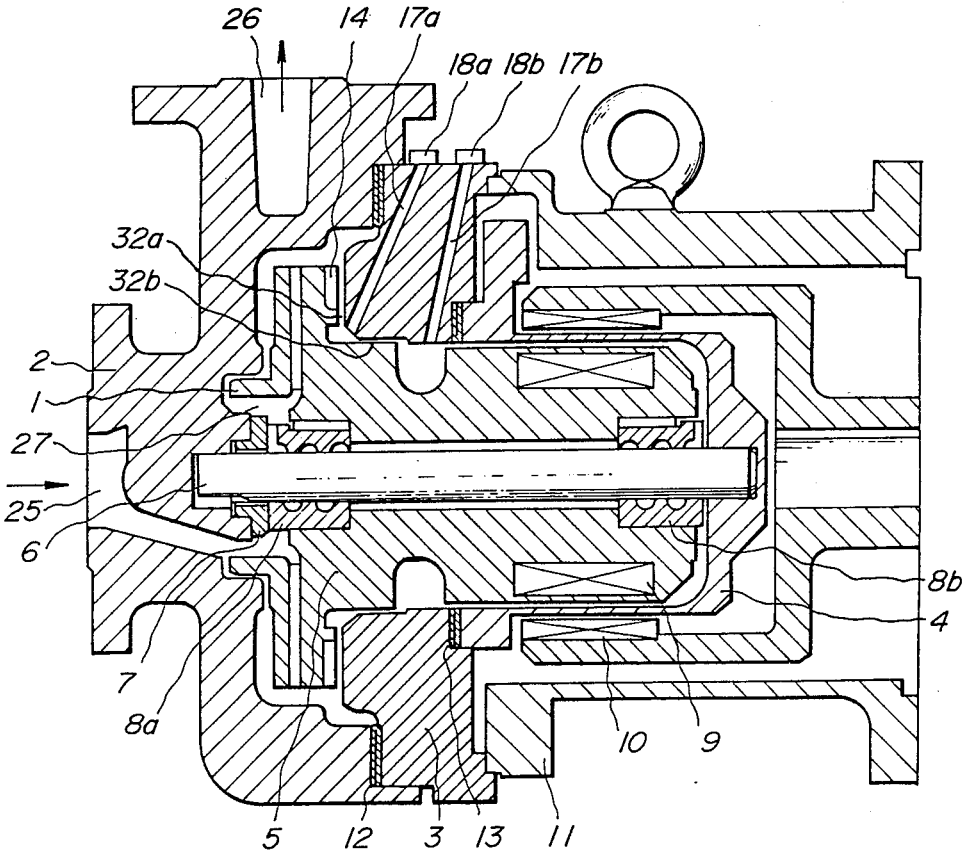
FIG. 3 is a sectional view of a leakless pump of a further embodiment of the invention.

FIG. 3 illustrates in section a further embodiment of the invention, wherein like components have been designated by the same reference numerals as those in FIG. 1 and will not be described in further detail. This embodiment shown in FIG. 3 is identical with the embodiment shown in FIG. 1 with exception that an orifice 32*a* is located at an inner side of rear blades 14 and an orifice 32*b* is located between an outer circumference of a rotor 5 and an inner surface of an end cover 3, and that an inner end of a pressure detecting aperture 17*a* opens between the orifices 32*a* and 32*b*, and an inner end of a pressure detecting aperture 17*b* opens into a space between the orifice 32*b* and an entry portion 27 of the rotor. With this arrangement, the liquid flows from a high pressure space at the outer circumference of the rotor through the rear blades 14, the orifices 32*a* and 32*b* and one orifice formed by helical grooves of bearings 8*a* and 8*b* into a low pressure space in the entry portion 27 of the rotor. The rear blades serve to urge the rotor 5 so as to cause the bearing 8*a* and a thrust bearing 7 to abut against each other. When the abutting surfaces of the bearing 8*a* and the thrust bearing 7 have worn off to widen the orifice 32*a* in an axial direction of the pump, the high pressure liquid at the outer circumference of the rotor flows into a space between the orifices 32*a* and 32*b* so as to be able the pressure detecting aperture 17*a* and a pressure sensor 18*a* to detect the pressure rise and hence bearing wear. When the front and rear bearings 8*a* and 8*b* have worn off in radial directions, clearances between a shaft 6 and the bearings 8*a* and 8*b* increase, with the result that the pressure in the pressure detecting aperture 17*b* lowers under the influence of the low pressure space in the entry portion 27. The lowered pressure in the pressure detecting aperture 17*b* is detected by the pressure sensor 18*b*, thereby detecting the wear of the bearings. It is preferable in this case that the orifice 32*b* is formed as long as possible in the axial direction of the pump, in order to avoid the influence of the pressure drop due to the wear of the bearings 8*a* and 8*b* in the radial directions.

EXAMPLE

A magnet pump as shown in FIG. 1 was prepared. The rotor 5 was formed with rear blades 14 (height of blades: 4.5 mm and rear blade gap 21: 3 mm), an orifice 15 (clearance: 0.6 mm and length: 10 mm) and balance holes 16 (number: 5 and diameter 6 mm). In this case, the outer circumference of an impeller was subjected to high pressure, the space from the rear blades to the orifice subjected to medium pressure and the space from the orifice to the balance holes subjected to low pressure. Revolution per minute of a motor 20 was 2900 rpm. Flow rate was 0.03–0.2 $m^3$/min.

With the magnet pump above described, when an end face of a bearing 8a and a thrust bearing 7 had worn and the rotor had shifted by 2 mm, the rear blade gap 21 enlarged from 3 mm to 5 mm and the length of the orifice changed from 10 mm to 8 mm, so that the effect of the rear blades lowered so as to raise the pressure at an inner circumference of the rear blades to change the relations in pressure between the respective portions.

Figure 4:
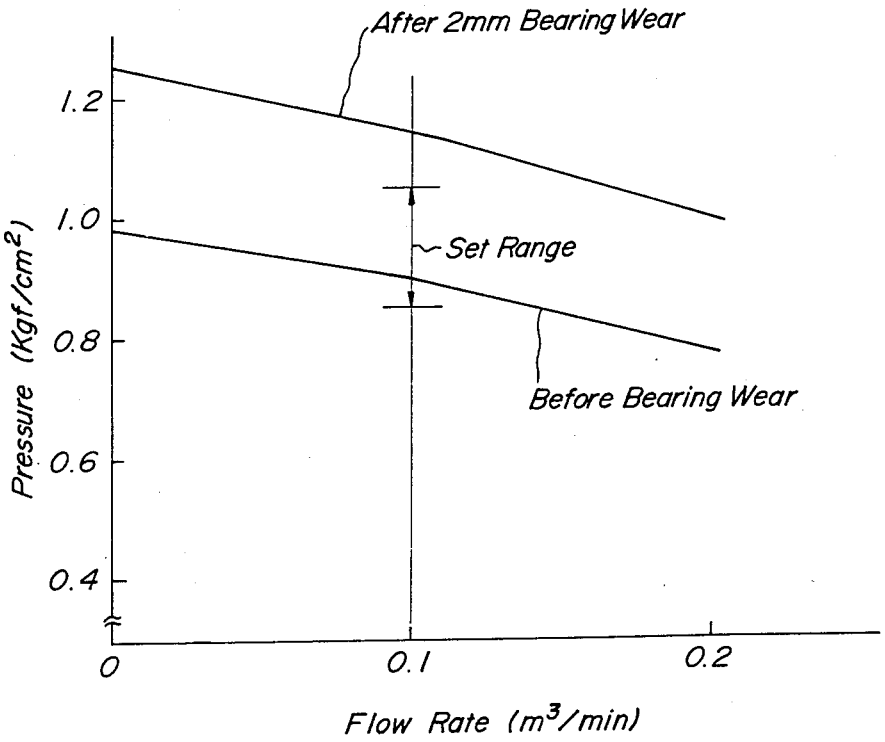
FIG. 4 is a graph illustrating pressure change for flow rate of the leakless pump.

FIG. 4 illustrates relations between the flow rate and the pressure measured by the pressure sensor 18 provided at the position shown in FIG. 1 when the bearing 8a and the thrust bearing 7 have not worn yet and when these bearings have worn off totally by 2 mm.

As can be seen from FIG. 4, when the bearings have worn by 2 mm, the pressure was average 0.25 kgf/cm$^2$ higher than the pressure before the bearing wear. Accordingly, a normal flow rate was set at 0.1 m$^3$/min and its threshold value was assumed within minimum 0.85 kgf/cm$^2$ and maximum 1.05 kgf/cm$^2$. In the event that the flow rate was out of the threshold value, the pump was stopped to advantageously prevent the bearing wear and to prevent the pump from being operated when sufficient liquid did not exist in the pump casing.

In the embodiments of the invention, the pressures in the respective spaces are adjusted by controlling the rotor 5 in the direction causing the front bearing 8a to abut against the thrust bearing 7. As an alternative, for this purpose the rear bearing 8b may of course be brought into contact with a separable thrust bearing (not shown) provided at the bottom of the cup-shaped member 4.

Moreover, the pressure detecting apertures may be opened at any locations, so long as the locations are in lower pressure portion including orifice and choking portions and communicating with the high pressure portion at the outer circumference of the rotor through the orifice and choking portions in the bypath, where the flow rate or hence the pressure in the bypath is changed owing to the bearing wear. Accordingly, they may be opened a surface of the casing in contact with the liquid. Moreover, although the casing and the end cover have been shown in separate members, they may be formed integrally with each other as a unitary body.

In the leakless pump having means for detecting the bearing wear explained in the above embodiments, the bearing wear can be effectively detected so long as it operates under the same used condition (flow rate). If the used condition (flow rate) of the pump is changed, the variation in pressure becomes large. In this case, therefore, it may be difficult to detect the bearing wear with the set constant pressure value, so that the means for detecting the bearing wear does not correspond to the variation in pressure.

Figure 5:
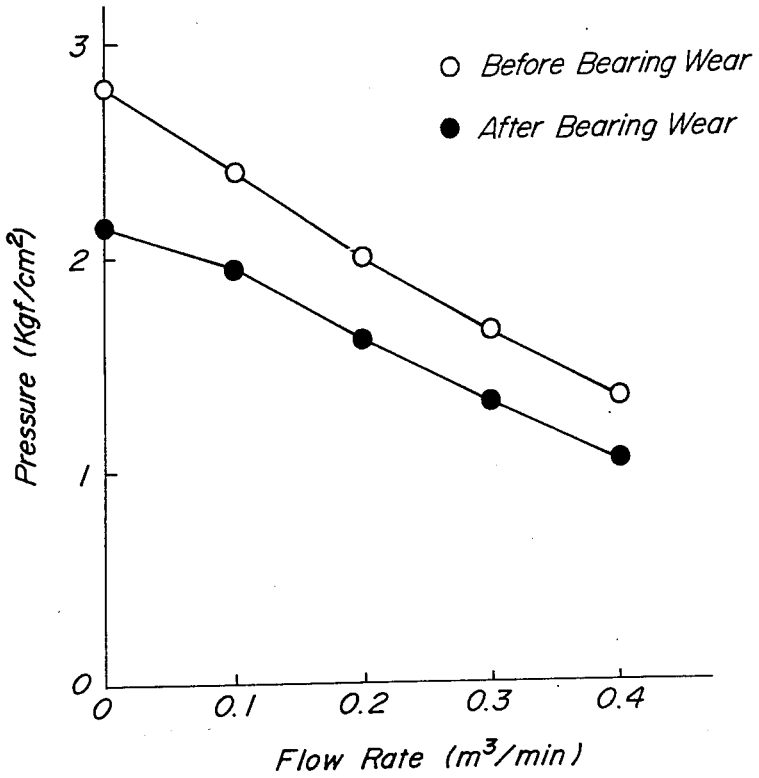
FIG. 5 is a graph illustrating pressure change for flow rate of the other leakless pump.

FIG. 5 illustrates another example of relation between the flow rate and the pressure of the leakless pump. For example, when the flow rate is 0.2 m$^3$/min, the pressure is 2 kgf/cm$^2$ and 1.6 kgf/cm$^2$ before and after the bearings have worn. Therefore, so long as the flow rate is kept constant as 0.2 m$^3$/min, signals are generated when the pressure becomes lower than 1.7 kgf/cm$^2$ to detect the bearing wear. However, when the flow rate is for example 0.4 m$^3$/min different from 0.2 m$^3$/min, the pressure become 1.35 kgf/cm$^2$ lower than 1.7 kgf/cm$^2$, under which condition the bearing wear cannot be exactly detected.

Figure 6:
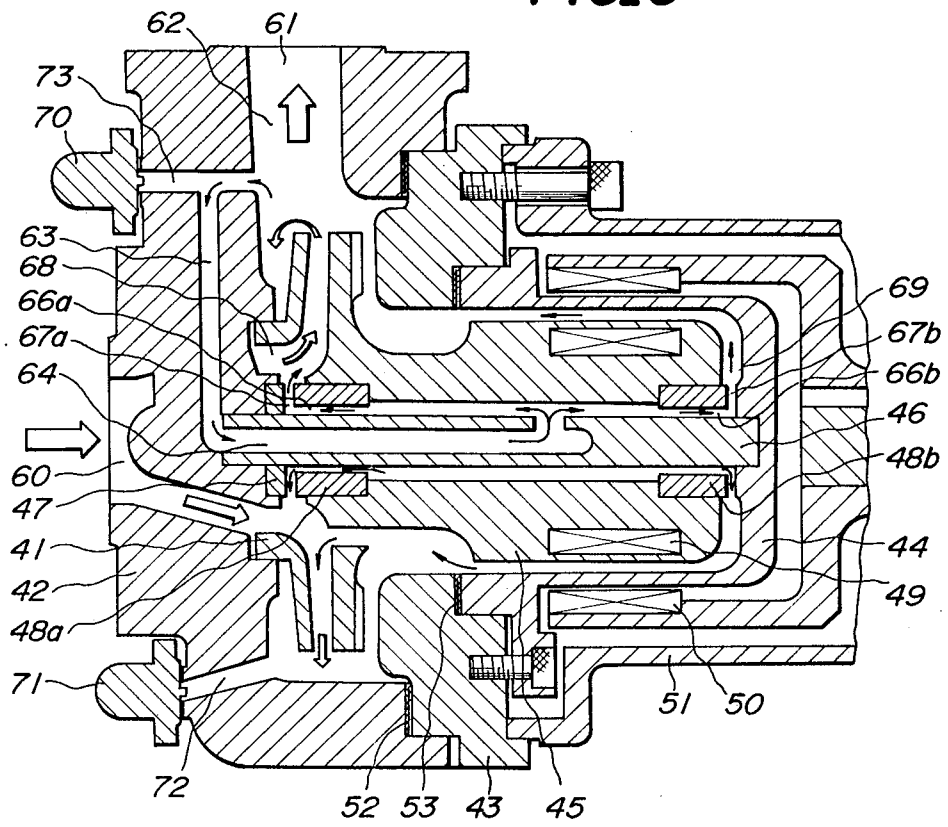
FIG. 6 is a sectional view illustrating a leakless pump of an improved embodiment of the invention.

FIG. 6 illustrates in section a further embodiment of the magnet pump as the leakless pump of the invention to solve the above problem. The leakless pump of this embodiment comprises a rotor 45 having a driven magnet 49 at one end and an impeller 41 at the other end and arranged on a shaft 46 fixed at both ends to a casing 42 and a can or a cup-shaped member 44 through a front bearing 48a and a rear bearing 48b. The rotor 45 is fitted on the front and rear bearings 48a and 48b so as to be rotatable relative to the shaft 46 with the aid of a thrust bearing 47. The casing 42, an end cover 43 and the cup-shaped member 44 are interconnected through gaskets 52 and 53 so that a liquid introduced through an inlet 60 of the casing 42 is fed in a liquid tight manner to an outlet 41.

Part of the liquid flows as shown by thin arrows from a high pressure space 62 at an outer circumference of the impeller 41 through a bypath 63 formed in the casing 42, a hollow passage 64 of the shaft 46 and sliding clearances 66a, 67a and 66b, 67b of the front and rear bearings 48a and 48b into low pressure spaces 68 and 69. A driving magnet 50 is provided in an outer circumference of the cup-shaped member 44 in opposition to the driven magnet 49. The driving magnet 50 is connected to a rotary shaft of a motor fixed through a stand 51 to the end cover 43 so that the driving magnet is rotated about the cup-shaped member 44 when the motor is energized.

In this embodiment, a pressure detecting aperture 73 communicating with the bypath 63 is arranged at a location where the liquid pressure changes before and after the bearings have worn off. The change in pressure before and after the bearing wear in this cse results from the fact that the bypath itself has a resistance to the liquid flow and the pressure drop becomes larger as the flow rate through the bearings increases due to the bearing wear. A pressure sensor 70 is provided at an outer end of the pressure detecting aperture 73 externally thereof. On the other hand, a further pressure detecting aperture 72 is arranged in the high pressure space in the casing 41 at a location where the liquid pressure does not change before and after the bearings have worn off. A pressure sensor 71 is provided at an outer end of the pressure detecting aperture 72 externally thereof. These pressure sensors 30 and 31 provided at the two locations simultaneously detect the pressures. The bearing wear is detected with the aid of pressure difference between the detected pressures.

The inventor carried out a wearing test using the magnet drive leakless pump as above constructed operated for 500 hours. The clearances 66a, 66b, 67a and 67b between the bearings 48a, 48b and 47 and the shaft 46 supporting the rotor rotating at high speeds were measured. The clearances changed from the normal condition before testing to the worn condition after testing as shown in Table 1. The pressures of a liquid were measured by the pressure sensors 70 and 71.

TABLE 1

| Clearance | 66a | 66b | 67a | 67b |
|---|---|---|---|---|
| Before testing (mm) | 0.05 | 0.05 | 0.1 | 0.5 |
| After testing (mm) | 0.3 | 0.3 | 0.1 | 2.5 |

In this case, owing to the change of the clearances or change of orifices, the flow shown by the thin arrows in FIG. 6 greatly changed. Namely, the widened clearances increased the flow rate in directions shown by the thin arrows, so that the pressure in the detecting aperture 73 lowered in reverse proportion to square of variation in speed of flow through the bypath 63 (refer to the Bernoulli's theorem). The results are shown in FIG. 7.

Figure 7:
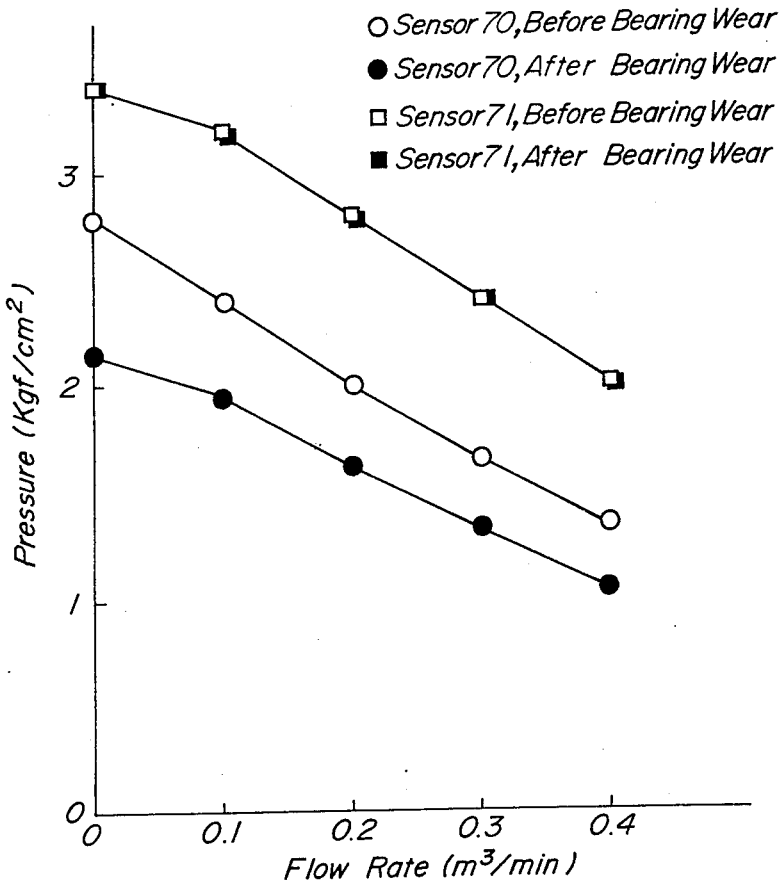
FIG. 7 is a graph illustrating relations between flow rates and pressures detected by respective pressure sensors used in the leakless pump shown in FIG. 6.
Figure 8:
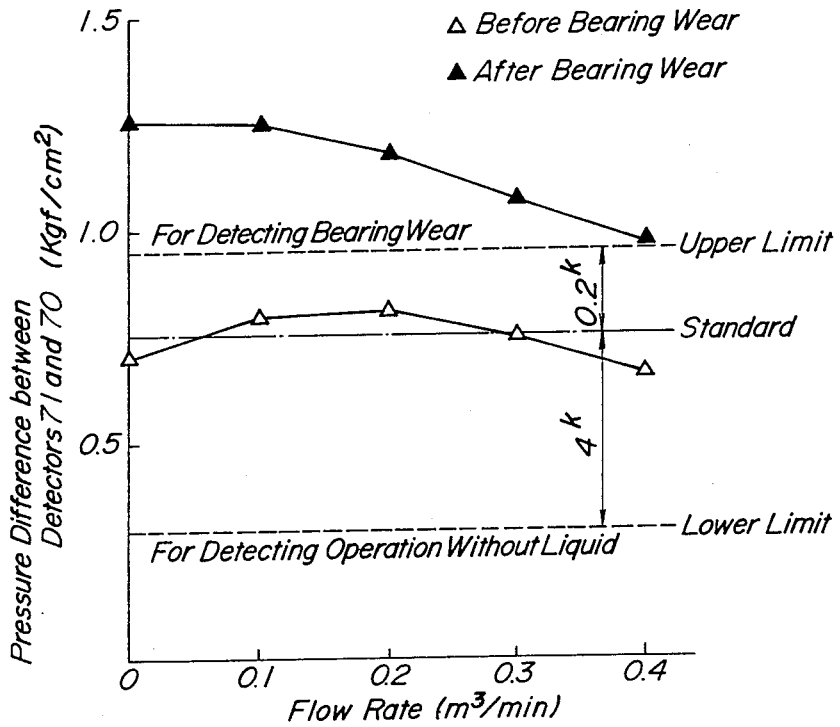
FIG. 8 is a graph illustrating relations between flow rates and pressure differences detected by respective pressure sensors of the leakless pump shown in FIG. 6.

From the results in FIG. 7, the pressure after the bearing wear measured by the sensor 70 is about 0.2 $kgf/cm^2$ lower than that before the bearing wear, thereby finding the bearing wear. However, as can be seen from FIG. 7, the pressure change resulting from flow rate change is so large that only the pressure sensor 70 can not compensate for the flow rate change. In this case, by the use of the pressures detected by the pressure sensor 70 and the pressures detected by the pressure sensor 71 provided for measuring the space where the pressure change is little, pressure differences therebetween are calculated, which are not greatly changed by the pressure change as shown in FIG. 8. As shown in FIG. 8, therefore, by setting an upper limit of the pressure difference at 0.95 $kgf/cm^2$, the pressure change due to the bearing wear can be exactly detected even if the flow rate changes. Moreover, if a lower limit of the pressure difference is set at 0.3 $kgf/cm^2$, the condition devoid of sufficient liquid in the pump can be detected to prevent the pump from being operated under such a condition.

Furthermore, if the hollow passage 64 of the shaft 46 is clogged, the pressure in the pressure detecting aperture 73 is raised so that the raised pressure can be detected to monitor the lubricated condition of the bearings.

Moreover, if the shaft 6 is broken, the pressure in the pressure detecting aperture 73 is lowered so that by detecting the lowered pressure the damage of the shaft 6 can be detected.

Figure 9:
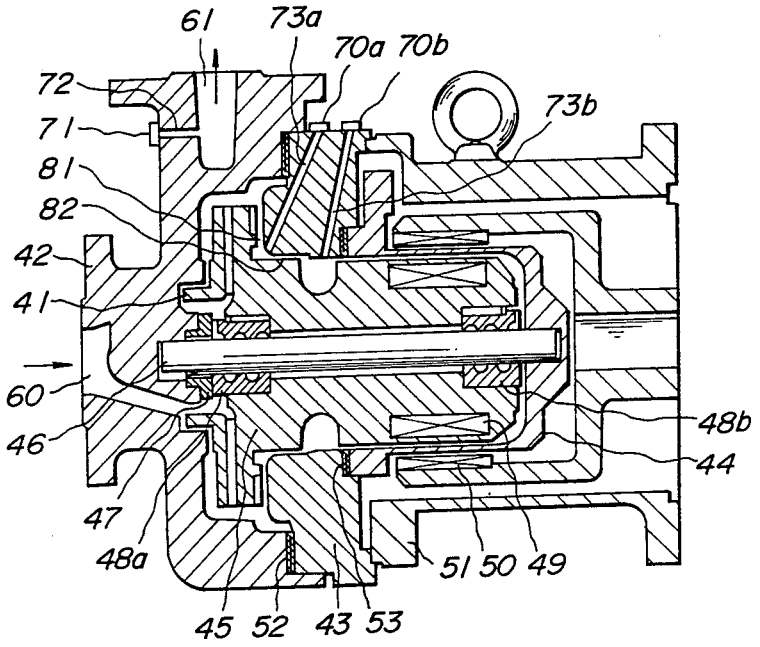
FIG. 9 is a sectional view illustrating a leakless pump of another embodiment of the invention.

FIG. 9 illustrates in section another embodiment of the leakless pump according to the invention, wherein like components have been designated by the same reference numerals as those in the embodiment shown in FIG. 6 and will not be described in further detail. The pump of this embodiment is similar to that of the embodiment shown in FIG. 6 with exception that a pressure sensor 71 and a pressure detecting aperture 72 are arranged in a high pressure space in a casing 71 where the liquid pressure is not changed before and after the bearing wear, and an orifice 81 at an inner circumference of rear blades and an orifice 82 at an outer circumference of a rotor 45 in opposition to an inner surface of an end cover 83 are provided. Moreover, pressure detecting apertures 73*a* and 73*b* are opened with their inner ends at locations between the orifices 81 and 82 and between the orifice 82 and an entry portion of the rotor where the pressure changes before and after the bearing wear. Pressure detectors 70*a* and 70*b* are provided at other ends of the pressure detecting apertures 73*a* and 73*b*. In this embodiment, pressure differences for example between the pressure sensors 71 and 70*a* and between the pressure sensors 71 and 70*b* among the three sensors are calculated and the pressure differences are always simultaneously monitored in the same manner as in the embodiment shown in FIG. 6 to detect the bearing wear more exactly.

Figure 10:
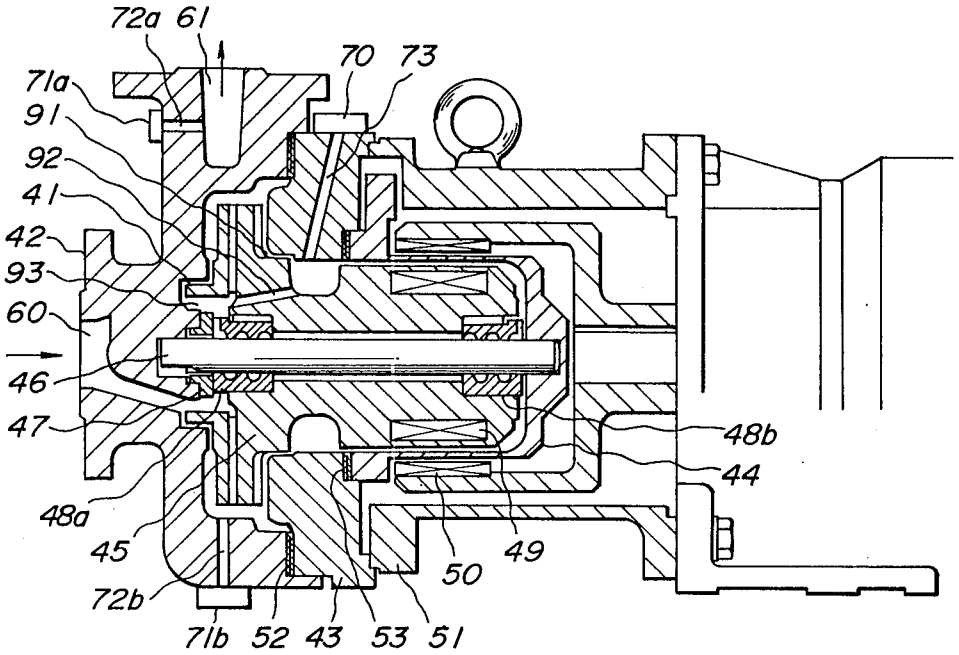
FIG. 10 is a sectional view of a leakless pump of a further embodiment of the invention.

In an embodiment shown in FIG. 10, an orifice 91 is provided at an outer circumference of a rotor 45 in opposition to an inner surface of an end cover 43 and balance holes 92 are provided in the rotor 45 so that part of the liquid passing through the orifice 91 flow through the balance holes 92 into an entry portion 93. In this embodiment, a pressure detecting aperture 73 is provided in the end cover 43 so as to open into a space between the orifice 91 and the balance holes 92 where the pressure changes before and after the bearing wear, and a pressure sensor 70 is provided at the other end of the pressure detecting aperture 73. Moreover, pressure detecting apertures 72*a* and 72*b* are provided in a casing 42 so as to open into high pressure spaces in the casing where the liquid pressure does not change before and after the bearing wear. Pressure sensors 71*a* and 71*b* are provided at other ends of the pressure detecting apertures 72*a* and 72*b*. Accordingly, pressure differences for example between the sensors 70 and 71*a* and between the sensors 70 and 71*b* among the three sensors are calculated and the pressure differences are always simultaneously monitored in the same manner as in the above embodiments to detect the bearing wear more exactly.

Figure 11:
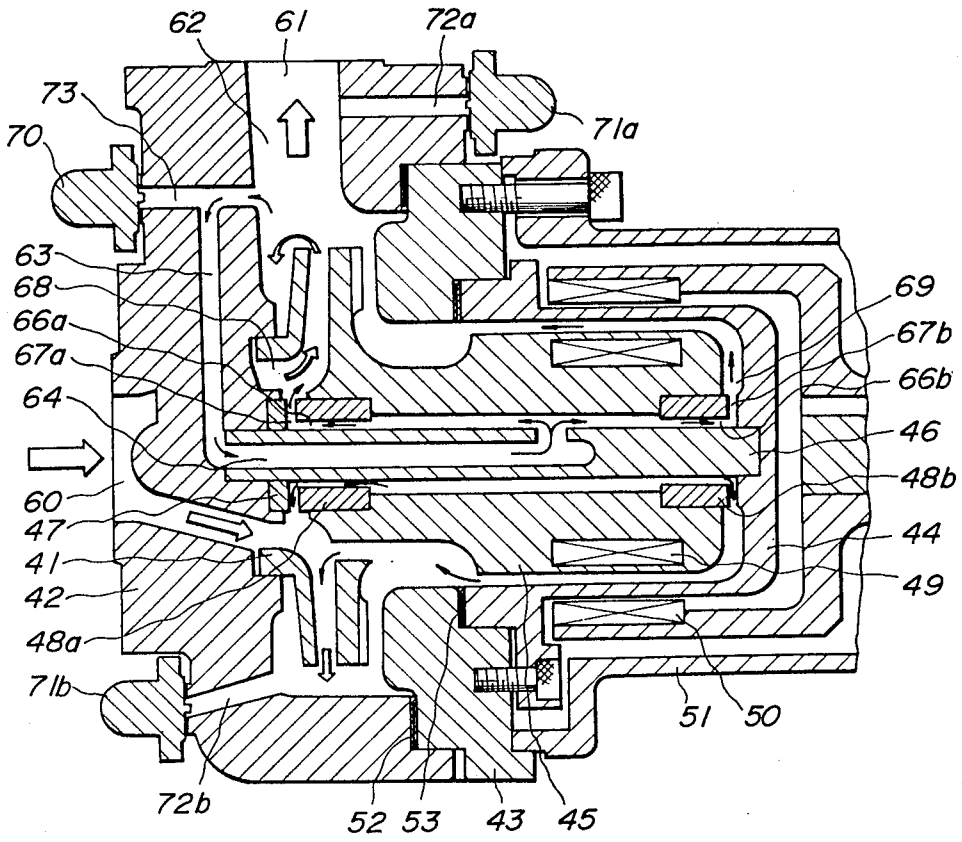
FIG. 11 is a sectional view of a leakless pump of an embodiment of the invention.

FIG. 11 illustrates one embodiment similar to the embodiment shown in FIG. 6 with exception that two pressure sensors 71*a* and 71*b* are provided so as to open into spaces where the liquid pressure does not change before and after the bearing wear. Namely, pressure detecting apertures 72*a* and 72*b* are opened in high pressure spaces in a casing 42, and pressure sensors 71*a* and 71*b* are provided at the other ends of the pressure detecting apertures 72*a* and 72*b*. Pressure differences for example between the pressure sensors 70 and 71*a* and between the pressure sensors 70 and 71*b* among the three pressure sensors 70, 71*a* and 71*b* are calculated, and the pressure differences are always simultaneously monitored to detect the bearing wear more exactly.

It will be understood that the invention is not limited only to the embodiments above described and various changes and modifications may be made in the invention. For example, although the magnet pump has been explained as embodiments of the invention, the invention can also be applicable to canned motor type pumps. Moreover, although the pressure sensor has been shown for detecting the pressures in the above embodiments, this invention is not limited to such a sensor and any means for detecting the pressure may of course be used.

In these embodiments, moreover, although the bearing wear is detected by measuring the pressure, it is of course possible to detect the bearing wear by measuring flow rates at two locations by means of electromagnetic flow meters, because of the relation of $\Delta v = \alpha\sqrt{\Delta P}$ where pressure change is $\Delta P$ and flow rate change is $\Delta v$.

As can be seen from the above description, the leakless pump having means for detecting the bearing wear according to the invention is always able to detect the worn condition of bearings without being affected by used conditions, particularly change in flow rate, to detect the time when the bearings are to be exchanged with new ones without any disassembling the pump and inspecting the bearings. Moreover, it is possible to effectively prevent the pump from being operated when a liquid does not exist in the casing, thereby ensuring the stable operation of the pump.

What is claimed is:

1. A leakless pump for pumping a liquid including a rotor having an impeller thereon and rotatably journaled by bearings, and a casing surrounding said rotor and said impeller, said pump comprising a bypath for flowing part of the liquid from a high pressure portion in the proximity of an outer circumference of said impeller to a low pressure portion on a side of an inlet of the pump, at least one pressure detecting aperture formed in said casing and having an inner end communicating with the fluid flow in said bypath for monitoring the flow and measuring a change in pressure in said bypath due to wear of at least one of said bearings, and pressure detecting means provided at an outer end of said pressure detecting aperture and in fluid comunication therewith for continuously detecting the pressure change in said bypath.

2. A leakless pump as set forth in claim 1, wherein said bearings consist of at least one thrust bearing and at least one radial bearing, and rear blades are provided on said rotor in opposition to said bypath to cause a thrust force in said rotor to bring the radial bearing into contact with said thrust bearing, thereby detecting pressure change in the bypath owing to increase of a rear blade gap due to wear of a contact surface of said bearings.

3. A leakless pump as set forth in claim 2, wherein said rotor is formed with balance holes communicating the lower pressure portion with an intermediate portion of said bypath.

4. A leakless pump as set forth in claim 2, wherein part of said bypath forming an orifice adjacent to said rear blade gap is inclined to an axis of said rotor and said inner end of said pressure detecting apertures is opened in the inclined orifice.

5. A leakless pump as set forth in claim 2, wherein two pressure detecting apertures are provided, one of which open near said rear blade gap for detecting increase in pressure in the bypath due to wear of the contact surface of said bearings, and the other of which is opened in the bypath surrounding said rotor for detecting decrease in pressure in the bypath due to wear of the radial bearing in radial directions.

6. A leakless pump as set forth in claim 2, wherein two pressure detecting apertures are provided, a first one of which open near said rear blade gap, and a second one of which opens in the bypath surrounding said rotor, and there is provided a further pressure detecting aperture opening in the high pressure portion and having pressure detecting means at an outer end.

7. A leakless pump as set forth in claim 2, wherein one pressure detecting aperture is provided, and there are two further pressure detecting apertures opening in the high pressure portion and having pressure detecting means at their outer ends, respectively.

8. A leakless pump as set forth in claim 1, wherein one pressure detecting aperture is provided, and there is a further pressure detecting aperture opening in the high pressure portion and having pressure detecting means at an outer end.

9. A leakless pump as set forth in claim 1, wherein one pressure detecting aperture is provided, and there are two further pressure detecting apertures opening in the high pressure portion and having pressure detecting means at their outer ends, respectively.

10. A leakless pump as set forth in claim 1, wherein said leakless pump is a magnet drive type pump.

11. A leakless pump as set forth in claim 1, wherein said leakless pump is a canned motor type pump.

* * * * *